US008424438B2

(12) United States Patent
Facciano et al.

(10) Patent No.: US 8,424,438 B2
(45) Date of Patent: Apr. 23, 2013

(54) MULTI-STAGE ROCKET, DEPLOYABLE RACEWAY HARNESS ASSEMBLY AND METHODS FOR CONTROLLING STAGES THEREOF

(75) Inventors: Andrew B. Facciano, Tucson, AZ (US); Sandie Y. Worley, Tucson, AZ (US); Robert D. Travis, Tucson, AZ (US); Dale O. Widmer, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 211 days.

(21) Appl. No.: 12/958,524

(22) Filed: Dec. 2, 2010

(65) Prior Publication Data

US 2012/0137653 A1 Jun. 7, 2012

(51) Int. Cl.
*F41F 3/04* (2006.01)
*H02G 3/04* (2006.01)

(52) U.S. Cl.
USPC ..... 89/1.56; 89/1.57; 89/1.811; 174/72 A

(58) Field of Classification Search ..... 89/1.56, 89/1.57, 1.811; 244/12.1, 12.3, 13, 14, 15, 244/23 R; 60/204, 229; 174/72 A
See application file for complete search history.

(56) References Cited

U.S. PATENT DOCUMENTS

| | | | | | |
|---|---|---|---|---|---|
| 3,183,468 | A | * | 5/1965 | Hennessy, Jr. | 439/157 |
| 3,598,015 | A | * | 8/1971 | Delistovich et al. | 89/1.814 |
| 3,897,028 | A | * | 7/1975 | Doellner | 244/3.1 |
| 4,522,103 | A | * | 6/1985 | Mitzner | 89/1.811 |
| 5,564,649 | A | * | 10/1996 | von Hoessle et al. | 244/3.12 |
| 5,652,404 | A | * | 7/1997 | Girard | 89/1.811 |
| 5,710,388 | A | * | 1/1998 | Hutchinson et al. | 89/1.811 |
| 6,343,954 | B1 | | 2/2002 | Facciano et al. | |

* cited by examiner

*Primary Examiner* — Bret Hayes
(74) *Attorney, Agent, or Firm* — Schwegman Lundberg & Woessner, P.A.

(57) ABSTRACT

A deployable raceway harness assembly for use with a multi-stage rocket includes a first cable bundle configured to extend across a second stage of a multi-stage rocket from a guidance unit to a first stage of the rocket. The deployable raceway harness assembly includes a deployable raceway cover configured for detachable coupling with the multi-stage rocket. The deployable raceway cover extends over at least the first cable bundle and a second cable bundle. The first cable bundle is fastened to the deployable raceway cover. The second cable bundle is configured to extend from the guidance unit to the second stage and is shorter than the first cable bundle. An in-flight deployment mechanism is configured to detach the deployable raceway cover and the first cable bundle extending across the second stage from the multi-stage rocket in-flight leaving the second cable bundle extending to the second stage in place.

30 Claims, 11 Drawing Sheets

MULTI-STAGE ROCKET, DEPLOYABLE RACEWAY HARNESS ASSEMBLY AND METHODS FOR CONTROLLING STAGES THEREOF

TECHNICAL FIELD

Multi-stage rockets and missiles. Some embodiments relate to raceway harness assemblies suitable for use in multi-stage rockets and missiles.

BACKGROUND

Multi-stage rocket and missile systems include complex guidance units configured to control rocket motors and attitude control systems (ACS) in a plurality of stages that are jettisoned after launch. The guidance unit controls each of the motors and ACSs through wires, including insulated and shielded cables, that run from the guidance unit to each of the motors and ACSs. Additionally, the guidance unit communicates with a vertical launch system (VLS). To maximize the range and burn out velocity of these systems the wires are conventionally run outside of the multiple stages and along the rocket exterior to optimize space for the rocket motors.

Attempts have been made to minimize the exterior profile of the wires and thereby minimize aerodynamic drag. In one example, the wires are laminated into the side of the rocket body to eliminate raceway covers and fasteners for coupling the cable to the rocket body. Lamination is generally used with smaller quantities of wire. In larger rockets with multiple stages and a larger corresponding number of wires lamination is difficult. Alternatively, lighter and flatter wires are used for lamination (e.g., integration into the rocket body). However, these wires lack the robust features of cabling needed for some missile applications including EMI shielding, insulation and the like.

Additionally, components in the wires and raceways are constructed with materials to reduce weight and thereby maximize burn out velocity. In one example, raceway covers are constructed with high temperature composites. Composite raceway covers are expensive, are susceptible to failure because of thermal loads and difficult to manufacture.

SUMMARY

In accordance with some embodiments, a deployable raceway cover and cable assembly is discussed that detaches from a multi-stage rocket after separation of one or more stages. Detachment of the raceway cover and the cables associated with the separated stages decreases the overall weight of the remaining portions of the missile, including a rocket motor, the guidance unit and a payload. Further, detachment of the raceway cover and the corresponding cables minimizes the aerodynamic profile of the missile. By reducing the weight and aerodynamic profile missile characteristics including burn out velocity, range, land area denied (defendable area where a missile defense system is able to intercept another missile) and the like may be optimized. Other features and advantages will become apparent from the following description of the embodiments, which description should be taken in conjunction with the accompanying drawings.

BRIEF DESCRIPTION OF THE DRAWINGS

A more complete understanding of the present subject matter may be derived by referring to the detailed description and claims when considered in connection with the following illustrative Figures. In the following Figures, like reference numbers refer to similar elements and steps throughout the Figures.

Elements and steps in the Figures are illustrated for simplicity and clarity and have not necessarily been rendered according to any particular sequence. For example, steps that may be performed concurrently or in different order are illustrated in the Figures to help to improve understanding of examples of the present subject matter.

DESCRIPTION OF THE DRAWINGS

In the following detailed description, reference is made to the accompanying drawings which form a part hereof, and in which is shown by way of illustration specific examples in which the subject matter may be practiced. These examples are described in sufficient detail to enable those skilled in the art to practice the subject matter, and it is to be understood that other examples may be utilized and that structural changes may be made without departing from the scope of the present subject matter. Therefore, the following detailed description is not to be taken in a limiting sense, and the scope of the present subject matter is defined by the appended claims and their equivalents.

The present subject matter may be described in terms of functional block components and various processing steps. Such functional blocks may be realized by any number of techniques, technologies, and methods configured to perform the specified functions and achieve the various results. For example, the present subject matter may employ various materials, actuators, electronics, shape, airflow surfaces, reinforcing structures, explosives and the like, which may carry out a variety of functions. In addition, the present subject matter may be practiced in conjunction with any number of devices, and the systems described are merely exemplary applications.

Figure 1:
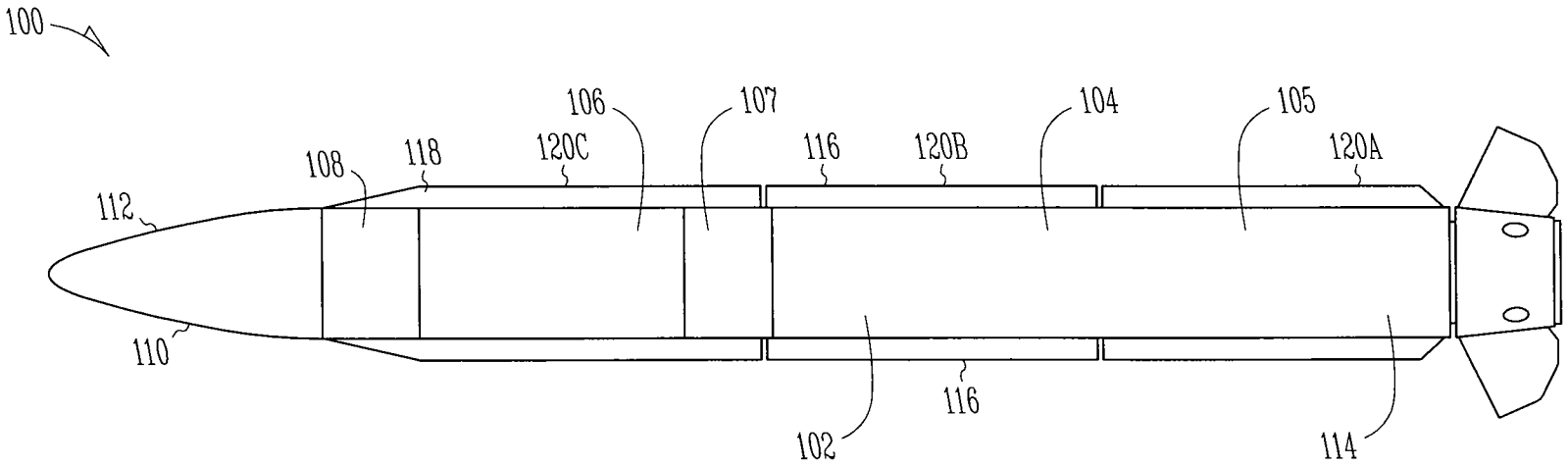
FIG. 1 is a side view of one example of a multi-stage rocket.

FIG. 1 shows one example of a multi-stage rocket 100 extending from a fore portion 112 to an aft portion 114. The multi-stage rocket 100 includes a multi-stage body 102. In the example shown in FIG. 1, the multi-stage body 102 includes a first stage 104 and a second stage 106. The first and second stages 104, 106 are coupled with a guidance unit 108 and a nose cone 110 carrying a payload. The second stage 106 is detachably coupled with the first stage 104 as will be described in further detail below. The first stage 104 is provided to launch the multi-stage rocket 100 and deliver the multi-stage rocket through a first segment of flight (e.g., through all or a portion of the atmosphere) while the second stage 106 is configured to deliver the multi-stage rocket through a second segment of flight after detachment of the first stage 104. The second stage 106 provides supplemental thrust to move the second stage 106 (without the mass and drag of the first stage 104), the guidance unit 108 and the nose cone 110 including a payload therein through the remainder of the atmosphere, and in some instances the second stage propels the multi-stage rocket 100 extra-atmospherically.

As shown in FIG. 1, the first stage 104 includes a first rocket motor 105 configured to provide the initial thrust described above. The second stage 106 includes a second rocket motor 107 to provide supplemental thrust and thereby increase the velocity of the multi-stage rocket 100 relative to the velocity attained with the first stage 104. As described above, the multi-stage rocket 100 further includes the guidance unit 108 coupled with the second stage 106. As shown in FIG. 1, the second stage 106 is coupled between the guidance unit 108 and the first stage 104. The multi-stage rocket 100 further includes a nose cone 110 including a payload therein. In one example, the payload included within the nose cone 110 includes one or more of a weapon system or space deliverable equipment including a satellite and the like. Although the multi-stage rocket 100 is shown with the first and second stage 104, 106 the multi-stage rocket 100, in another example, includes a plurality of stages including a first stage, a second stage, a third stage and supplement stages as needed for the particular application of the multi-stage rocket 100.

The multi-stage rocket 100 further includes a deployable raceway harness assembly 116 extending along the multi-stage body 102. As shown in FIG. 1, the deployable raceway harness assembly 116 includes a raceway cover 118 extending from adjacent to the guidance unit 108 to the first stage 104. The raceway cover 118 protects cable bundles and other sensitive rocket parts on the exterior of the multi-stage body 102 during atmospheric supersonic flight (e.g., buffeting and heating). As will be described in further detail below, the raceway cover 118 provides a raceway channel configured for reception of cable bundles for electrical coupling between the guidance unit 108, the second stage 106 and the first stage 104. The guidance unit 108 is thereby able to communicate booster and attitude control, ignition, separation instructions and the like to each of the stages 104, 106. In another example, the guidance unit 108 is connected with a vertical launch system through cable bundles received within the raceway cover 118. Optionally, the cable bundles for the launch system are delivered through the raceway cover and are coupled with the launch system through ports within the raceway cover 118.

In one example, the cabling included within each of the deployable raceway harness assemblies 116 includes ignition cabling, launch system communication cabling, attitude cabling, and cabling configured to initiate separation of one or more of the first and second stages 104, 106 relative to the guidance unit 108. In addition to cabling providing each of these functions the cable bundles further include electromagnetic shielding insulation and the like configured for protection and strengthening of the cables to ensure reliable delivery of the multi-stage rocket 100 to the target. In another example, the cable bundles include radio frequency wave guides, mechanical linkages, pyrotechnic cabling, electronics and pressurized gas lines alternatively or in addition to the electronic cabling previously described. In some examples, the cabling for each of the first and second stages 104, 106 along with the raceway covers 118 extending over the cabling is a significant portion of the overall weight of the multi-stage rocket 100 and is thereby additional mass that is carried by the rocket along each of the first and second stages 104, 106. As described below, the deployable raceway harness assembly 116 provides a system for separation for cable bundles associated with each of the stages 104, 106 during one or more of launch and flight. Separation of the cable bundles (e.g., the length extending from the guidance unit to the associated stage) decreases the overall weight of the multi-stage rocket 100 and thereby optimizes the burnout velocity of the multi-stage rocket 100 after complete consumption of the rocket motors therein.

In another example shown in FIG. 1, the deployable raceway harness assembly 116 includes a duplicate raceway assembly on an opposed surface of the multi-stage body 102. For instance, a second deployable raceway harness assembly 116 is positioned 180 degrees around the multi-stage body 102 to provide identical aerodynamic surfaces on each side of the multi-stage rocket 100. The second deployable raceway harness assembly 116, in one example, includes third and fourth cable bundles configured for coupling with one or more of the first stage 104 and the second stage 106 as well as the launch system where necessary. Inclusion of the third and fourth cable bundles within the second deployable raceway harness assembly provides for equal weight distribution around the multi-stage rocket 100 and thereby improves the flight characteristics of the rocket. Optionally, supplemental deployable raceway harness assemblies 116 are provided around the multi-stage rocket 100. For instance, the multi-stage rocket 100 includes four deployable raceway assemblies 116 deployed equidistantly around the multi-stage rocket 100 (e.g., at 90 degrees relative to each other).

Referring again to FIG. 1, the raceway cover 118 incorporates multiple segments 120A-C. For instance, a first segment 120A extends over a portion of the first stage 104, a second segment 120B extends over a second portion of the first stage 104 and a third segment 120C extends over the second stage 106 and over at least a portion of the guidance unit 108. Each of the first through third segments 120A-C provides continuous coverage and protection for the cable bundles extending along the multi-stage body 102 to the various points of electrical coupling with each of the first and second stages 104, 106 as well as the vertical launch system, described above. In one example, segments 120A, B are associated with a single stage, such as the first stage 104. The segments 120A, B are separated to float (move) relative to each other and allow for expansion of one or more of the stage 104 and the rocket motor 105 during operation. The separate segments 120A, B cooperate with fasteners, such as floating nut plates (describe below) to allow the segments of the raceway cover to float (move) as needed with expansion of the stage.

Returning to the example where the multi-stage rocket 100 includes first and second stages 104, 106, the first stage 104 is jettisoned from the multi-stage rocket 100 after depletion of the first rocket motor 105. Jettisoning of the first stage 104 decreases the overall weight of the multi-stage rocket 100 and facilitates greater acceleration and velocity of the remaining portion of the multi-stage rocket 100 including, for instance, the nose cone 110, the guidance unit 108 and the second stage 106. In other examples where the multi-stage rocket 100 includes first, second and third stages, the first and second stages are sequentially jettisoned as their respective motors are depleted to sequentially reduce the weight (and drag in atmosphere) of the multi-stage rocket after launch and prior to delivery of the payload to the target.

Figure 2:
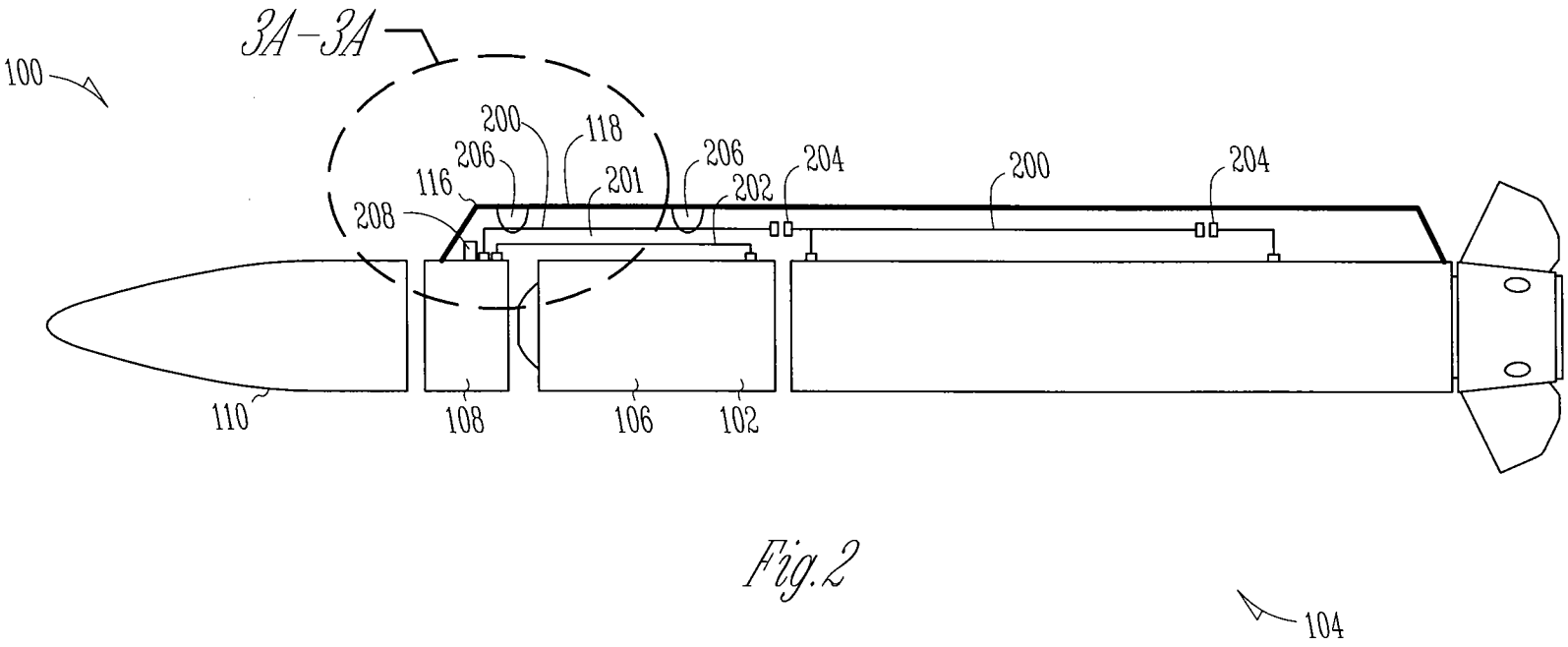
FIG. 2 is a side view of the multi-stage rocket of FIG. 1 with a raceway cover sectioned to expose a plurality of separate cable bundles and a deployable raceway harness assembly.

FIG. 2 shows another view of the multi-stage rocket 100 including the deployable raceway harness assembly 116. As previously described, the deployable raceway harness assembly 116 includes a raceway cover 118 extending along at least a portion of the multi-stage body 102. FIG. 2 shows the deployable raceway harness assembly 116 having a first cable bundle 200 extending from the guidance unit 108 toward the first stage 104 of the multi-stage rocket 100. Referring again to the first cable bundle 200, the bundle includes cabling for ignition, attitude control, separation of the stages, and communication with the launch system prior to launching of the multi-stage rocket 100. The multi-stage rocket 100 further includes a separate second cable bundle 202 running between the guidance unit 108 and the second stage 106. As shown in FIG. 2, the second cable bundle 202 is separated from the first cable bundle and runs separately within the raceway channel 201 of the raceway cover 118. In a similar manner to the first cable bundle 200, the second cable bundle 202 provides communication between the guidance unit 108 and the second stage 102 including for instance, but not limited to, ignition instructions, attitude control and separation initiation to jettison the second stage 106 from the guidance unit 108.

As shown in FIG. 2, the first cable bundle 200 includes one or more quick disconnect junctures 204 positioned along the first cable bundle 200. For instance, in the example shown, quick disconnect junctures 204 are incorporated in the first cable bundle. As the multi-stage rocket 100 jettisons the components 104, 106 the quick disconnect junctures facilitate easy decoupling of the portions of the first cable bundle 200 associated with each of the segments of the multi-stage rocket 100. Similarly, where the raceway cover 118 includes multiple segments such as the segments 120A-C shown in FIG. 1 the corresponding segments of the raceway cover are similarly jettisoned with the corresponding stages of the multi-stage rocket 100 as they separate (e.g., where segments 120A, B are not part of the raceway harness assembly and simply separate with the first stage 104 as it is separated).

The deployable raceway harness assembly 116 associated with the second stage 106 includes the raceway cover 118 extending between the guidance unit 108 and second stage 106. As previously described, the first and second cable bundles 200, 202 extend separately through the raceway channel 201 of the raceway cover 118. That is to say, the first and second cable bundles are bundled separately and form two distinct runs of cable that are not fixed with each other. As will be described in further detail below, the first cable bundle 200 is harnessed to the raceway cover 118 through bundle fasteners 206 extending between the raceway cover 118 and the first cable bundle to forming the deployable raceway harness assembly 116. The second cable bundle 202 is fastened with the second stage 106 and the guidance unit 108 and is separated from the first cable bundle 200.

As described in further detail below, the deployable raceway harness assembly 116 further includes an in-flight deployment mechanism 208 configured to separate the raceway cover 108 as well as the first cable bundle 200 fastened with raceway cover 118. Separation of the deployable raceway harness assembly 116 including the raceway cover 118 and the first cable bundle 200 eliminates the significant mass of the raceway cover 118 as well as the mass of the first cable bundle 200 thereby decreasing the weight of the remaining multi-stage rocket 100 including the second stage 106, the guidance unit 108 and the nose cone 110 having the payload therein. Stated another way, in previous rocket designs after separation of a stage the portion of the cabling previously used for control of the jettisoned stage remains attached to the multi-stage rocket along the remaining stages or the guidance unit. The cabling in effect becomes ballast without any other function. This ballast contributes weight to the overall rocket and thereby decreases the rocket performance (for instance, the rocket burnout velocity). In contrast, with the multi-stage rocket 100 after separation of the first stage 104 from the rocket 100, the first cable bundle 200 extending along the second stage 106 and the guidance unit 108 is jettisoned as part of the deployable raceway harness assembly (e.g., with the raceway cover 118). The second separate cable bundle 202 remains attached to the rocket body 102 and couples the second stage 106 with the guidance unit 108.

In at least some examples, the first cable bundle 200 comprises 80 percent or more of the overall cabling (and weight) held within the raceway channel 201 in contrast to the 20 percent of the overall cabling comprising the second cable bundle 202. For example, the first cable bundle 200 includes cabling for one or more stages, launch cabling and the like while the second cable bundle 202 includes cabling for the second stage 106. In one example, the first cable bundle 200 includes 100 or more wires with insulation, shielding and the like for the functions described above while the second cable bundle 202 includes 20 wires or less. By jettisoning the first cable bundle 200 and the raceway cover 118 a significant weight decrease for the remaining multi-stage rocket 100 is thereby realized that enhances the capabilities of the rocket including, for instance, optimizing burnout velocity, land area denied (defendable area where a missile defense system is able to intercept another missile) and the like.

Figure 3B:
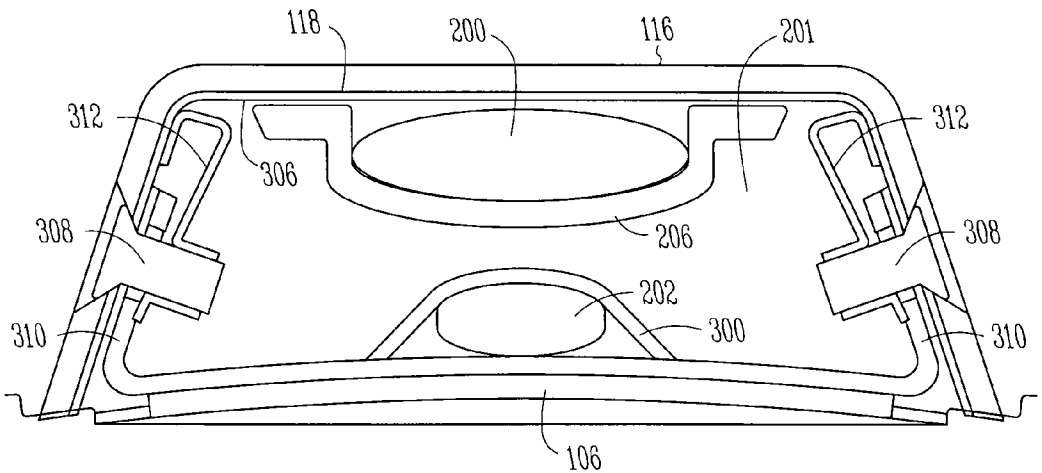
FIG. 3B is a detailed sectional view of the deployable raceway harness assembly taken along line B-B in FIG. 3A.
Figure 3A:
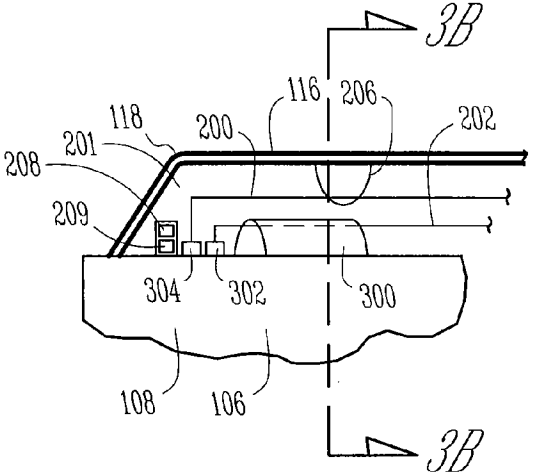
FIG. 3A is a detailed sectional view of the deployable raceway harness assembly shown in FIG. 2.

FIG. 3A shows a detailed view of the deployable raceway harness assembly 116. As previously described, the assembly 116 includes a raceway cover 118 including a raceway channel 201 configured to receive two or more cable bundles, for instance the first cable bundle 200 and second cable bundle 202. As shown in FIG. 3A, the first cable bundle 200 is coupled to the raceway cover 118 by a bundle fastener 206. The second cable bundle 202 is coupled with the guidance unit 108 and second stage 106 of the multi-stage 102. As previously described, the first and second bundles 200, 202 are separated from each other to facilitate the separation of the first cable bundle 200 after separation of the first stage 104 (shown in FIG. 1). The first cable bundle 200 provides control functions to the first stage 104, and after separation of the first stage the first cable bundle 200 is ballast and no longer needed. Jettisoning of the first cable bundle 200 with the raceway cover 118 thereby acts to eject ballast from the remainder of the multi-stage rocket 100 including, for instance, the guidance unit 108, the second stage 106 and the nose cone 110 carrying the payload of the multi-stage rocket.

Referring to FIGS. 3A and 3B, the first cable bundle 200 is shown fastened to the raceway cover 118 with a bundle fastener 206. The bundle fastener 206 couples the first cable bundle 200 to the raceway cover 118 and facilitates removal of the first cable bundle 200 with the raceway cover 118. As shown in FIG. 3B, the bundle fastener 206 is coupled with a cover interior surface 306 extending along at least a portion of the raceway channel 201. In one example, the bundle fastener 206 includes a series of straps extending along portions of the cover interior surface 306. In still another example, the bundle fastener 206 includes a continuous web of material extending from one end of the raceway cover 118 to another end of the raceway cover. The first cable bundle 200 is retained along the raceway cover 118 with the bundle fastener 206 and thereby separated from the second cable bundle 202.

The second cable bundle 202 is retained along the multi-stage body 102 with a bundle covering 300. As shown in FIG. 3A, for instance, the second cable bundle 202 is retained along the second stage 106 and the guidance unit 108. In a similar manner to the bundle fastener 206, in one example, the bundle covering 300 includes straps configured to extend across the second cable bundle 202 and retain the second cable bundle tightly along the multi-stage body 102. In another example, the bundle covering 300 includes an insulated tape, such as Kapton tape (a heat and electromagnetic insulating tape), and tightly positions the length of the second cable bundle 202 along the multi-stage body 102 including the guidance unit 108 and the second stage 106. Coupling of the second cable bundle 202 along the multi-stage body 102 provides a small aerodynamic profile for the second cable bundle 202 (relative to the profile of the raceway cover 118). After separation of the raceway cover 118 the small aerodynamic profile ensures the second cable bundle 202 is protected from atmospheric buffeting. Additionally, the bundle covering 300, for instance the Kapton taping described above, provides electromagnetic and heat shielding to the second cable bundle 202 and thereby protects the second cable bundle during travel of the multi-stage rocket 100 in exo-atmospheric flight.

Referring again to FIG. 3A, the second cable bundle 202 is shown connected with the guidance unit 108 through a junction 302. In one option, the second cable bundle 202 is coupled to the guidance unit 108 with a semi-permanent or permanent juncture 302 because the second cable bundle 202 remains coupled with the guidance unit 108 and second stage 106 after separation of the raceway cover 118 and the first cable bundle 200.

The first cable bundle 200 is connected with the guidance unit 108 with a quick disconnect juncture 304. The quick disconnect juncture 304 facilitates the easy separation of the first cable bundle 200 from the guidance unit 108 during separation of the raceway cover 118 from the multistage rocket 100. Optionally, the portion of the first cable bundle 200 shown in FIG. 3A is further coupled with another portion of the first cable bundle 200 running to the first stage as shown in FIG. 2. For example and as previously described, the first cable bundle 200 adjacent to the guidance unit 108 and the second stage 106 is coupled with the portion of the first cable bundle 200 extending along the first stage 104 with another quick disconnect junction 204 as shown in FIG. 2. Provision of the quick disconnect juncture 204 between the second stage 106 and the first stage 104 facilitates detachment of one portion of the first cable bundle 200 from the other portion of the first cable bundle during separation of the first stage 104 from the second stage 106. Stated another way, by including the quick disconnect juncture 204 along the first cable bundle 200 the portion of the first cable bundle extending along the first stage 104 easily separates from the remaining portion of the first cable bundle 200 coupled along the guidance unit 108 and the second stage 106. The remaining portion of the first cable bundle 200 extending along the second stage 106 is thereafter jettisoned from the remainder of the multi-stage rocket 100 as part of the deployable raceway harness assembly 116 (e.g., the raceway cover 118) immediately or sometime after separation of the first stage 104.

Referring now to FIG. 3B, a cross-section of the deployable raceway harness assembly 116 is shown taken along line B-B relative to the sectional view provided in FIG. 3A. As shown, the first cable bundle 200 and the second cable bundle 202 separately extend through the raceway channel 201. As previously described, the first cable bundle 200 is coupled with the cover interior surface 306 of the raceway cover 118 through one or more bundle fasteners 206. Similarly, the second cable bundle 202 is coupled with the multi-stage body 102 with a bundle covering 300. The first and second cable bundles 200, 202 are assembled separately and thereafter coupled separately to the raceway cover 118 and the multi-stage body 102, respectively. As shown in FIG. 3B, the raceway cover 118 coupled with the first cable bundle 200 is coupled with the second stage 106 through one or more fasteners 308. For instance, the raceway cover 118 is coupled by way of one or more fasteners 308 such as countersunk screws driven through the raceway cover 118 and engaged with a raceway bracket 310 and a floating nut plate 312. FIG. 3B shows one example of a method for coupling the raceway cover 118 and the first cable bundle 200 with the multi-stage body 102. Other examples for coupling the raceway cover 118 with the multi-stage body 102 include but are not limited to adhesives, mechanical interfittings, fasteners such as rivets, and the like.

Referring back to FIG. 3A, the deployable raceway harness assembly 116 further includes an in-flight deployment mechanism 208 configured to separate the raceway cover 118 as well as the first cable bundle 200 coupled with the raceway cover from the multi-stage rocket 100 (see FIG. 1). In one example, the in-flight deployment mechanism 208 includes an explosive charge positioned near the fore portion 112 of the multi-stage rocket 100 (see FIG. 1). As shown in FIG. 3A, for instance, the in-flight deployment mechanism includes an explosive charge 209 positioned immediately beneath the fore portion (leading edge) of the raceway cover 118. The explosive charge 209 provides concussive force configured to separate the raceway cover 118 as well as the first cable bundle 200 from the multi-stage rocket 100. For instance, the explosive charge 209 is positioned within the raceway cover 118 to separate the raceway cover 118 and rotate the raceway cover 118 away from the multi-stage rocket 100. By rotating the raceway cover 118 and the first cable bundle 200 away from the multi-stage rocket 100 interference with the flight of the multi-stage rocket is substantially avoided. In one example, the raceway cover 118 includes a hinge assembly at the aft portion of the raceway cover to assist in rotating the raceway cover 118 away from the multi-stage body 102 of the multi-stage rocket 100. Referring to FIG. 3B, where an explosive charge 209 is used to separate the raceway cover 118 the explosive charge provides sufficient concussive force to shear the raceway fasteners 308 coupled between the raceway cover 118 and the raceway bracket 210 where the bracket 210 is coupled with the second stage 106. In still other examples, the in-flight deployment mechanism 208 includes a series of features such as rails that facilitate the sliding separation of the raceway cover 118 and the first cable bundle 200 relative to the multi-body 102. These features and other exemplary in-flight deployment mechanisms 208 will be described in further detail below.

Figure 4:
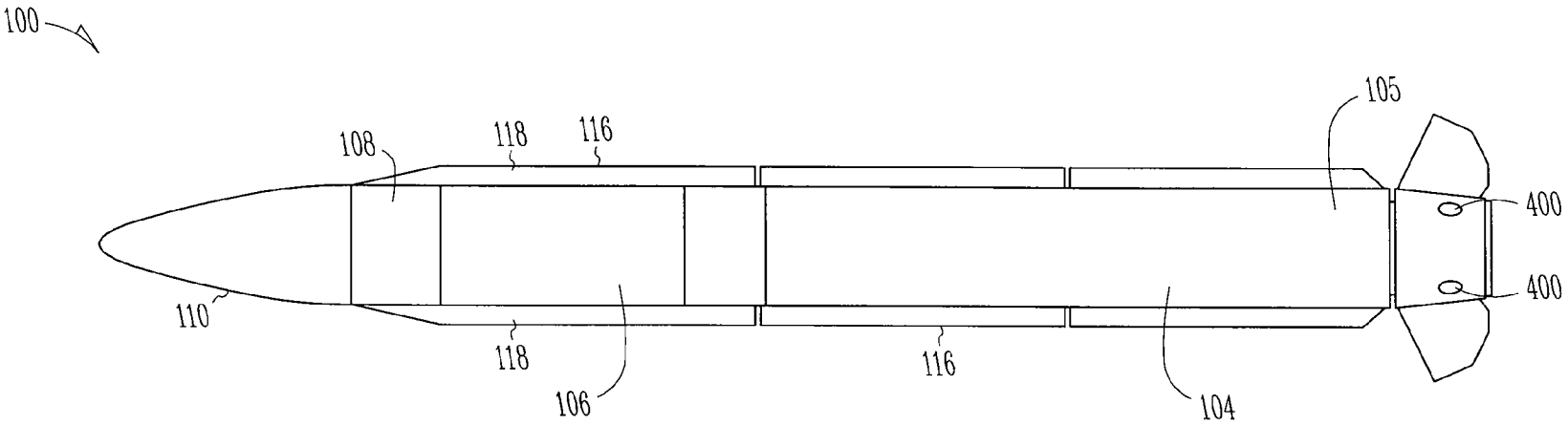
FIG. 4 is a side view of a multi-stage rocket prior to separation of a first stage.

FIGS. 4-7 show one example of a multi-stage rocket 100 in various configurations including the configuration at launch, configurations during ignition and operation of the first and second stages as well as the configuration for deployment of a payload. Referring first to FIG. 4, the multi-stage rocket 100 is shown in a substantially similar form to that shown in FIG. 1. The multi-stage rocket 100 includes one or more stages including, for instance, a first stage 104 and a second stage 106. As previously described, the first stage 104 includes a first rocket motor 105 and the second stage 106 includes a second rocket motor 107 (described further below). As previously described above, the multi-stage rocket 100 includes a deployable raceway harness assembly 116 extending along at least one side of the multi-stage rocket. The deployable raceway harness assembly 116 contains a plurality of cable bundles extending through a raceway channel within the raceway cover 118. Each of the cable bundles is connected with one of the first and second stages 104, 106 and electrically couples the first and second stages with the guidance unit 108, respectively. For instance, in the configuration shown in FIG. 4 the cable bundle (first cable bundle 200 shown in FIG. 2) extending from the guidance unit 108 through the raceway cover 118 to the first stage 104 provides ignition instructions, attitude control instructions for the first stage attitude control nozzles 400 and further controls operation of the first rocket motor 105. Additionally, the cable bundle extending from the guidance unit 108 to the first rocket motor 105 provides additional instructions in one example for separation of the first stage 104 from the second stage 106 after completion of the first rocket motor 105 operation. In still another example, the deployable raceway harness assembly 116 including, for instance, the first cable bundle 200 extending to the first stage 104 includes launch cabling configured for coupling with a launch system, such as a vertical launch system. The launch cabling is configured to transmit instructions hack and forth between the guidance unit 108 and the launch system.

Figure 5:
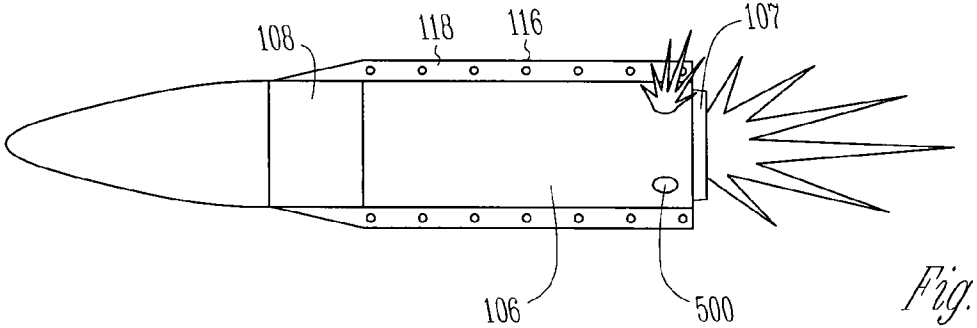
FIG. 5 is a side view of the multi-stage rocket shown in FIG. 4 after separation of the first stage.

FIG. 5 shows the multi-stage rocket 100 after separation of the first stage 104. After operation of the first rocket motor 105 is completed the first stage 104 becomes ballast relative to the remainder of the multi-stage rocket 100. Separation of the first stage 104 from the second stage 106 is then initiated. By separating the first stage 104 from the remainder of the multi-stage rocket 100 a significant amount of weight is eliminated from the multi-stage rocket and the second stage 106 is thereafter able to initiate operation of the second rocket motor 107. As previously described, in one example, the first cable bundle extending through the raceway cover 108 (see FIG. 2) includes quick disconnect junctures to facilitate decoupling of one portion of the first cable bundle from another portion of the first cable bundle extending along the first stage 104. Separation of the first stage 104 thereby splits the first cable bundle and allows the first stage 104 to deploy from the multi-stage rocket 100. The second cable bundle 202 extending from the guidance unit 108 to the second stage 106 is configured to operate the second rocket motor 107 as well as the second stage attitude control nozzles 500. The guidance unit 108 is thereby able to control the operation of the second rocket motor 107 as well as the attitude of the multi-stage rocket 100 by delivering instructions to the second stage 106. Operation of the second rocket motor 107 and the second stage attitude control nozzles 500 propels and guides the multi-stage rocket toward the target.

Figure 6:
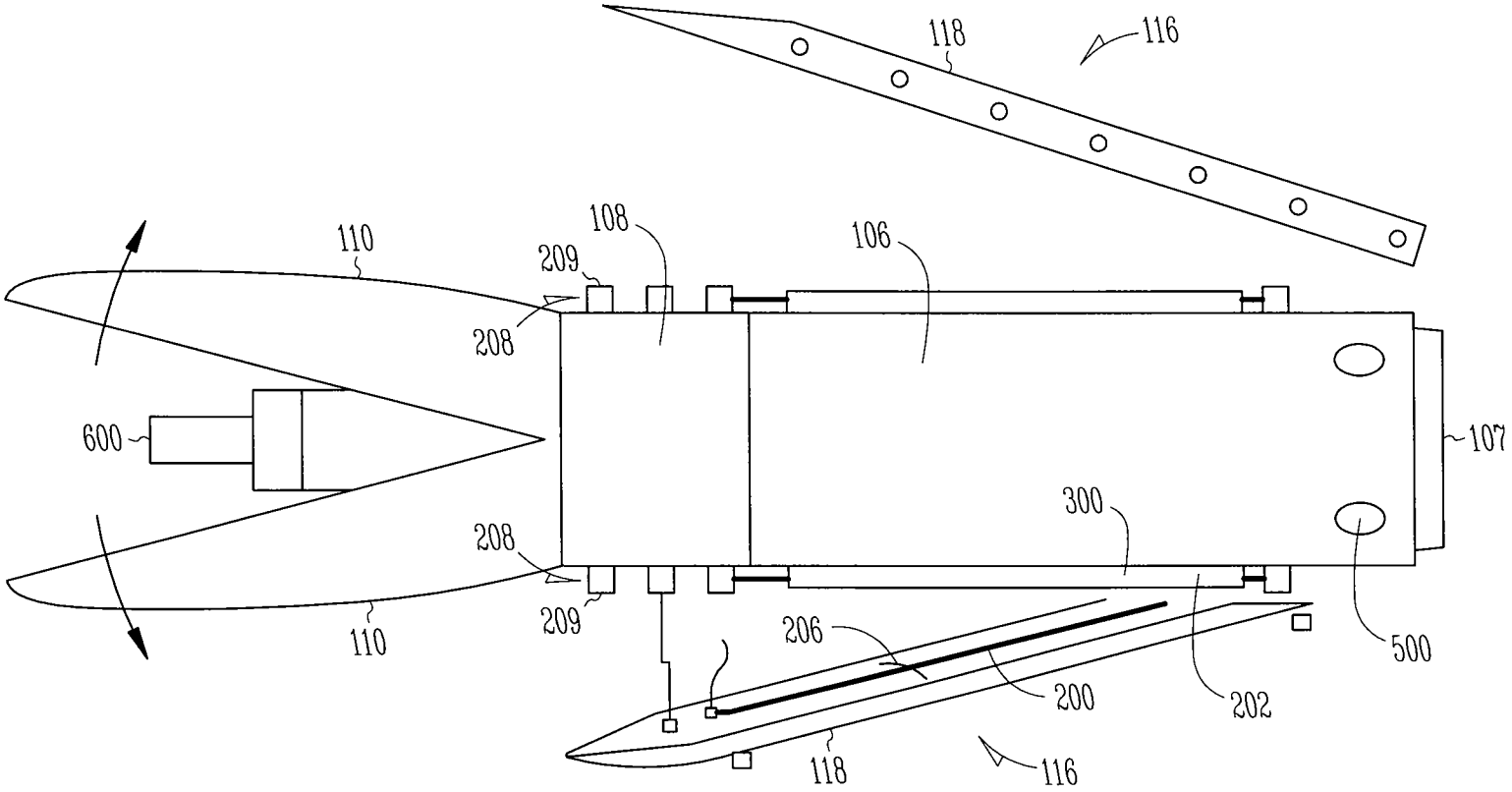
FIG. 6 is a side view of the multi-stage rocket shown in FIG. 5 at separation of a plurality of deployable raceway harness assemblies including raceway covers and attached first cable bundles.

FIG. 6 shows the multi-stage rocket 100 in another configuration after separation of the first stage 104. As previously described in FIG. 5, the second stage 106 provides booster propulsion as well as attitude control to the multi-stage rocket 100 after separation of the first stage 104. In one example, as shown in FIG. 6, the nose cone 110 is in the process of separating from the multi-stage rocket 100 to deploy a payload 600. FIG. 6 further shows the deployable raceway harness assembly 116 (including the raceway covers 118 and the associated first cable bundles 200) separating from the multi-stage rocket 100 including the second stage 106 and the guidance unit 108. After separation of the deployable raceway harness assembly 116 the second cable bundle 202 remains fastened with the multi-stage rocket through the bundle coverings 300. The second cable bundle 202 provides control instructions to the second stage 106, for instance the second rocket motor 107 and the second stage attitude control nozzles 500. In another example, the second cable bundle 202 transmits instructions to initiate the separation of the second stage 106 from the guidance unit 108 and payload 600.

As previously described, the deployable raceway harness assembly 116 includes the raceway cover 118 as well as the first cable bundle 200 fastened to the raceway cover 118 with one or more bundle fasteners 206. As described herein, separation of the deployable raceway harness assembly 116 minimizes the weight of the multi-stage rocket 100 by removing the raceway covers 118 that are no longer needed near the end of atmospheric flight or after exit of the multi-stage rocket 100 from atmosphere. Additionally, jettisoning of the deployable raceway harness assembly 116 removes the first cable bundle 200 extending along each of the opposed surfaces of the multi-stage rocket 100 (where the rocket includes two or more assemblies 116). Removal of the first cable bundle 200 used for the control of the first stage 104 (previously separated) as well as the launch cabling used for communication with the launch system minimizes the overall weight of the cabling used in the remaining portion of the multi-stage rocket 100 (e.g., the second cable bundle 202). Stated another way, the second cable bundle 202 remains fastened along the surface of the guidance unit 108 and the second stage 106 to provide control to the second rocket motor 107 and second stage attitude control nozzles 500 while the first cable bundle 200 is jettisoned with the raceway cover 118. That is to say, the raceway cover 118 and the first cable bundle 200 are no longer needed after the first stage 104 separation and become ballast to the multi-stage rocket 100. By separating the first cable bundle 200 from the second cable bundle 202 and then fastening the first cable bundle 200 with the deployable raceway cover 118 the weight of the multi-stage rocket is optimized (e.g., minimized) during operation of the second stage 106 because the ballast of the cover 118 and the first cable bundle 200 is jettisoned. Separation of the deployable raceway harness assembly 116 thereby minimizes the overall weight of the multi-stage rocket 100 and correspondingly optimizes the burnout velocity of the multi-stage rocket 100 to increase the range of the multi-stage rocket 100 as well as the coverage for the payload 600 (e.g., land area denied in the context of a missile defense system).

FIG. 6 further shows one example of in-flight deployment mechanisms 208 configured to separate each of the deployable raceway harness assemblies 116 from the multi-stage rocket 100. In one example, the in-flight deployment mechanism includes an explosive charge 209 positioned near the fore portion of the raceway cover 118. For instance, the explosive charge 209 is positioned beneath the raceway cover 118 in the installed position shown in FIG. 5. Initiation of the explosive charge 209 provides a concussive moment to the raceway cover 118 and rotates the raceway cover 118 relative to the second stage 106 and the guidance unit 108 to thereby push the deployable raceway harness assembly 116 away from the multi-stage rocket 100 without interfering with the flight of the rocket. In other examples (described below), other flight deployment mechanisms including but not limited to an assembly of rails and slots on the deployable raceway harness assembly 116 and the second stage 106 permits the sliding disengagement of the raceway cover 118 and the first cable bundle 200 attached to the raceway cover 118 to separate the harness assembly without interfering with multi-stage rocket flight. In the example with sliding rails an explosive charge is optional and the resulting lateral concussion from the explosive charge is eliminated or minimized to thereby correspondingly minimize the lateral forces incident on the multi-stage rocket 100 during deployment of the harness assembly 116.

As previously described, separating the deployable raceway harness assembly minimizes the mass carried by the multi-stage rocket 100 after separation of the first stage 104. Because the deployable raceway harness assembly 116 includes not only the raceway cover 118 but the first cable bundle 200 a larger percentage of weight relative to the mass of the multi-stage rocket 100 is disengaged from the rocket to optimize the velocity realized through operation of the second rocket motor 107. In previous rocket designs the cables for the first stage 104 and second stage 106 were coupled together to minimize the space used within the raceway cover 118, and deployment of the raceway cover 118 by itself only lessened the weight of the multi-stage rocket by the mass of the raceway cover or covers. In contrast, by separating the first cable bundle 200 from the second cable bundle 202, for instance by isolating each of the bundles according to the particular control functions provided (i.e., for the second stage 106 and first stage 104, respectively) and coupling the first cable bundle 200 with the raceway cover 118, the jettisoning of the raceway cover also separates the first cable bundle 200 from the rocket to realize even greater weight savings compared to jettisoning the raceway cover 118 by itself. Deployment of the first cable bundle 200 thereby further minimizes the weight of the multi-stage rocket 100 by not only the raceway cover 118 but also the weight of the first cable bundle 200. The remainder of the cables, for instance, the second cable bundle 202 on the surface of the second stage 106 and the guidance unit 108 are only needed for operation of the second rocket motor 107 and the second stage attitude control nozzles 500 as opposed to a consolidated bundle of cables including cabling used for the second stage 106 as well as for the first stage 104. That is to say, cables for the first stage 104 that would otherwise remain on the second stage 106 after deployment of the raceway cover 118 are instead jettisoned with the raceway covers 118 as ballast thereby minimizing the weight of the multi-stage rocket 100 to increase the velocity of the multi-stage rocket 100 and other desirable delivery characteristics (such as land area denied).

Furthermore, the weight saving benefit realized by jettisoning the deployable raceway harness assemblies 116 including the raceway covers 118 and the first cable bundles 200 is maximized because the mass of the deployable raceway harness assembly is much larger relative to the overall mass of the multi-stage rocket 100 after separation of the first stage 104. Stated another way, once the first stage 104 is jettisoned from the multi-stage rocket 100 the remaining cables such as the first cable bundle 200 and the raceway cover 118 constitute a much larger percentage of the overall weight of the multi-stage rocket 100 with the payload 600 guidance unit 108 and second stage 106 (but not the first stage 104). Separation of the deployable raceway harness assembly 116 thereby realizes a much greater reduction of the remaining weight of the multi-stage rocket 100. As stated previously, because the relative weight of the multi-stage rocket 100 after separation of the first stage 104 is minimized the corresponding burnout velocity possible with the second rocket motor 107 is optimized in contrast to a rocket that retains the cabling not only for the second stage 106 but also the first stage 104.

As previously described, in one example, the raceway cover 118 and the first cable bundle 200 are separated from the multi-stage rocket 100 immediately prior or after the multi-stage rocket 100 exits the atmosphere. The raceway cover 118 is provided in part to maintain an aerodynamic profile for the first and second cable bundles 200, 204 during atmospheric flight. Immediately prior to exiting the atmosphere and after exiting the atmosphere the raceway covers 118 are no longer needed and are simply ballast relative to the multi-stage rocket 100. In another option, the deployable raceway harness assemblies 116 (including the raceway covers 118 and the first cable bundles 200) are separated from the multi-stage rocket 100 earlier in-flight, for instance, as the multi-stage rocket 100 moves into the rarified atmosphere at relatively higher altitudes but prior to exiting the atmosphere. For instance, the first cable bundles 200 and the raceway covers 118 attached to the cable bundles are detached at lower altitudes to decrease the weight of the rocket earlier in the operation of the second stage rocket motor 107 and thereby maximize the velocity attained. The remaining second cable bundle 202 is tightly fastened along the second stage 106 and provides a smaller aerodynamic profile. In the example where the deployable raceway harness assemblies 116 are separated from the multi-stage rocket 100 at lower altitudes the nose cone 110 remains over the payload 600 to protect the payload during atmospheric flight. In yet another option, the deployable raceway harness assemblies 116 are separated immediately after completion of the first rocket motor operation and the first stage 104 separation to immediately decrease the overall weight of the rocket. In another example (described above), where the deployable raceway harness assemblies 116 are deployed immediately prior to or after exiting the atmosphere the nose cone 110 and the harness assemblies 116 are separated from the multi-stage rocket 100 at substantially the same time.

In other examples, where additional stages (e.g., third stage, fourth stage and the like) are included with the multi-stage rocket 100 at launch additional weight savings and attendant increases in velocity are achieved as additional cabling bundles (having increased lengths for runs to additional stages spaced from the guidance unit) are needed for each stage that may then be jettisoned as ballast after separation of the stage. In yet another example, where one or more of the raceways 118 includes launch cabling either alone or with the first stage cable bundle additional weight savings and increases in burn out velocity are achieved where the launch cabling as part of the first stage cable bundle is jettisoned as part of the deployable raceway harness assembly 116.

Figure 7:
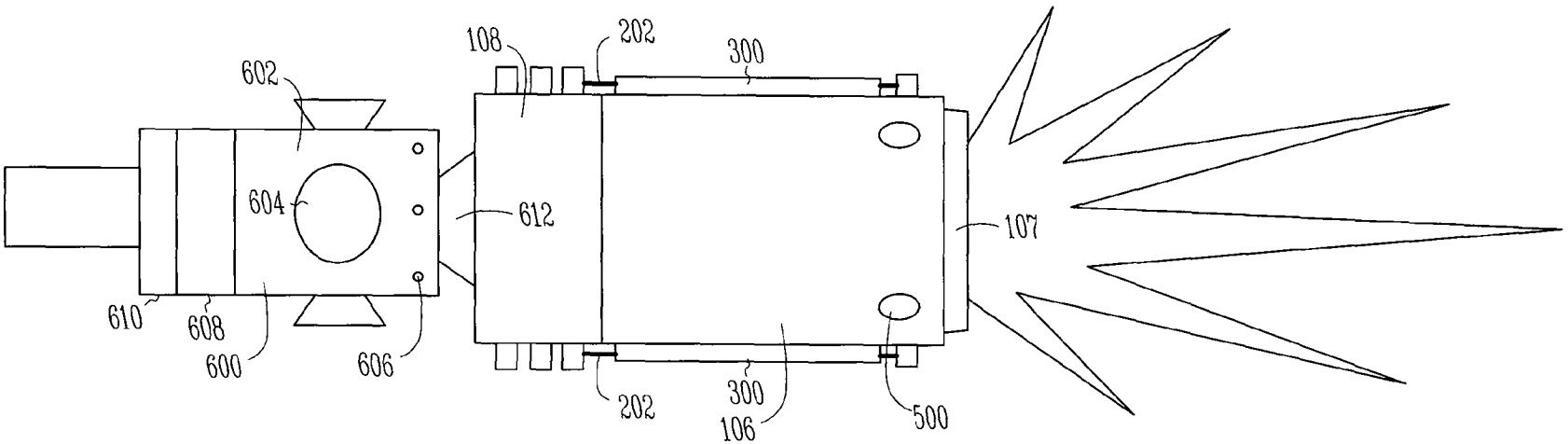
FIG. 7 is a side view of the multi-stage rocket shown in FIG. 6 after separation of the nose cone and the deployable raceway harness assemblies.

FIG. 7 shows the multi-stage rocket 100 after deployment of the deployable raceway harness assembly 116 and the nose cone 110. As shown, the second stage 106 remains coupled with the guidance unit 108. The guidance unit 108 is coupled with the payload 600. As shown in FIG. 7, the payload 600 includes, in one example, a weapons system such as an explosive warhead, nuclear weapon or the like. The payload 600 further includes a divert attitude control system 602 configured to provide course adjustments to the multi-stage rocket 100 for precise delivery of the rocket to the target. For instance, the divert attitude control system 602 includes divert jets 604 configured to laterally move the multi-stage rocket 100 from a previous trajectory. In another example, the divert attitude control system 602 includes one or more payload attitude control nozzles 606 configured to rotate the multi-stage rocket 100 onto a new trajectory or make course corrections midflight. The payload 600, in another example, includes a guidance electronics unit 608 configured to communicate with the divert attitude control system 602 to steer the payload 600 after separation from the second stage 106. An ejector mechanism 612 is provided between the payload 600 and the guidance unit 108 to separate the second stage 106 and the guidance unit 108 from the payload 600 after completion of the operation of the second rocket motor 107. In one example, the ejector mechanism 612 includes an explosive charge. In another example the ejector mechanism 612 includes a mechanical latching system configured to release the payload 600 from the guidance unit 108 according to instructions from the guidance electronics unit 608. Optionally, the multi-stage rocket 100 includes a seeker suite 610 with the payload 600. In one example, the seeker suite includes electronics and sensors configured to guide the payload 600 to the target site.

In another example, the multi-stage rocket 100 shown in FIGS. 1 and 4-7 is part of a three (or more) stage rocket, as described above. In this example, the first stage is a booster coupled with a second stage (e.g., the first stage 104 in the Figures), and a third stage (e.g., the second stage 106) is coupled with the guidance unit 108. With a multi-stage rocket including three or more stages the operation of the deployable raceway harness assembly 116 is substantially similar and operates on the same principle—separation of the harness assembly along the remaining stages where the cabling for a previously jettisoned stage (e.g., the first stage of three stages) is no longer needed. For instance, after separation of the first stage (attached to the second and third stages 104, 106, respectively) cabling used for operation of a first stage rocket motor, first stage attitude control system, vertical launch system cabling and the like becomes ballast. The deployable raceway harness assembly 116 shown in FIG. 4 extending along both of the second and third stages 104, 106 is separated any time after ignition of the second stage rocket motor 105 (e.g., first stage rocket motor 105 as previously described). Separation of the raceway harness assembly 116 from both of the second and third stages 104, 106 jettisons the raceway covers 118 and the cable bundles previously used to operate the first stage (now jettisoned). The weight of the remaining rocket including the second and third stages is thereby decreased by the combined weight of the cover 118 (in one or more segments, e.g., 120A-C) and the cable bundles running over both stages for use in the first stage. Use of the raceway harness assembly 116 achieves greater weight reduction for each additional stage added to the rocket. Each additional stage requires supplemental cabling having additional length and weight to account for the extra length of the additional stage. By jettisoning the longer and thereby heavier cable bundles and covers for the added stages greater weight savings is realized with attendant greater increases in missile characteristics, such as burn out velocity.

Figure 8:
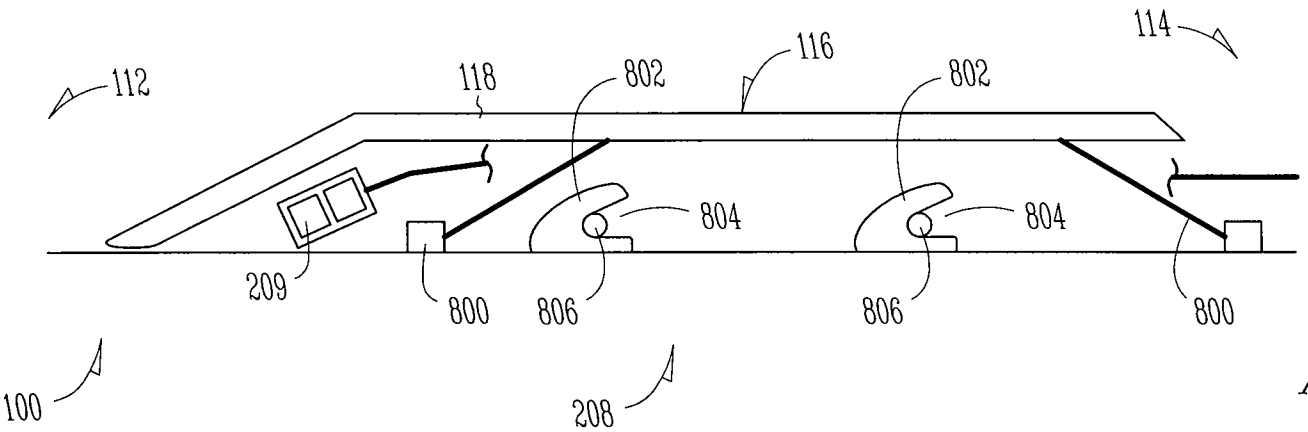
FIG. 8 is a sectional view of one example of a deployable raceway harness assembly including an in-flight deployment mechanism.

FIGS. 8 through 11 provide various examples of in-flight deployment mechanisms, such as the deployment mechanism 208 shown in FIG. 2. Referring first to FIG. 8, one example of an in-flight deployment mechanism 208 is shown including an explosive charge 209. The multi-stage rocket 100 is shown with the deployable raceway harness assembly 116 coupled along the multi-stage rocket 100. As shown, the deployable raceway harness assembly 116 includes a raceway cover 118 extending along the multi-stage rocket 100. As previously described, the deployable raceway harness assembly 116 further includes a cable bundle attached to the raceway harness 118 and configured to separate with the raceway harness 118 upon deployment of the harness assembly 116. The cable bundle is not shown in FIG. 8 to assist in viewing of the in-flight deployment mechanism 208. The in-flight deployment mechanism shown in FIG. 8 includes one or more raceway clips 802 positioned along the multi-stage rocket 100. As shown each of the raceway clips 802 includes a release recess 804 directed toward the aft portion 114 of the multi-stage rocket 100. As will be described in further detail below the aft directed release recesses 804 ensure the deployable raceway harness assembly 116 easily separates from the multi-stage rocket 100 and deploys toward the aft portion of the rocket without interfering with operation of, for instance, the second stage 106. The raceway cover 118 further includes a plurality of raceway bars 806 sized and shaped for reception within the release recesses 804 of the raceway clips 802. One or more deployment restraints 800 coupled with the raceway cover 118 ensure the raceway bars 806 are retained within the release recesses 804 prior to operation of the explosive charge 209. Stated another way, the deployment restraints 800 pull the raceway bars 806 into the release recesses 804 and retain the raceway bars 806 therein until the explosive charge 209 initiates an explosive reaction within the raceway cover 118 to fracture the deployment restraint 800 and thereby release the deployable raceway harness assembly 116.

In operation the explosive charge 209 is initiated and provides a concussive reaction within the raceway cover 118. The concussive force provided by the explosive charge 209 fractures the deployment restraint 800 (e.g., a cable, rod or the like extending from the multi-stage rocket 100 to the raceway cover 118) and frees the raceway bars 806 from their retention within the release recesses 804 on the raceway clips 802. Additionally, the explosive charge 209, in one example, provides a moment to the raceway cover 118 and rotates the raceway cover 118 as well as the attached cable bundle (such as the first cable bundle 200) away from the multi-stage rocket 100. As shown in FIG. 8, each of the release recesses 804 includes a tapering recess that opens toward the aft portion 114 of the multi-stage rocket 100 thereby allowing the raceway cover 118 to rotate away in a clockwise direction from the multi-stage rocket 100. In yet another example, the in-flight deployment mechanism shown in FIG. 8 includes a supplemental deployment restraint 800 near the aft portion 114 of the raceway cover 118. The deployment restraint 800 positioned at the aft portion 114 provides additional restraint for the raceway cover 118 and further prevents unintended deployment of the raceway cover 118 of the deployable raceway harness assembly 116 until initiation of the explosive charge 209.

Figure 9:
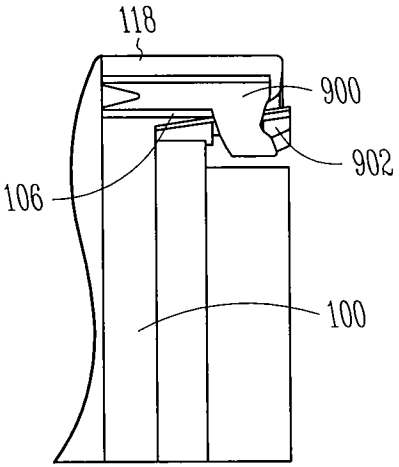
FIG. 9 is a sectional view of one example of a hinge configured to assist with separation of the deployable raceway harness assembly.

Referring to FIG. 9, another optional component of the in-flight deployment mechanism 208 is shown. The raceway cover 118 is shown coupled with the multi-stage rocket, for instance, along the second stage 106. As previously described, in one example, rotation of the deployable raceway harness assembly 116 away from the multi-stage rocket 100 is desired. In FIG. 9, a raceway hinge 900 is provided with the raceway cover 118 to facilitate rotation of the raceway cover 118 away from the multi-stage rocket 100. The raceway hinge 900 is received within a portion of the second stage 106 and is engaged at a fulcrum 902 within the second stage 106. When the raceway cover 118 and the associated cable bundle are detached from the multi-stage rocket 100, for instance after initiation of the explosive charge 209, the raceway hinge 900 ensures that the moment provided to the raceway cover 118 continues to rotate the raceway cover 118 about the raceway hinge 900 and the fulcrum 902 to ensure the raceway cover 118 and the cable bundle attached to the raceway cover rotate away from the multi-stage rocket 100 as opposed to sliding along or colliding with the multi-stage rocket after separation.

Figure 10:
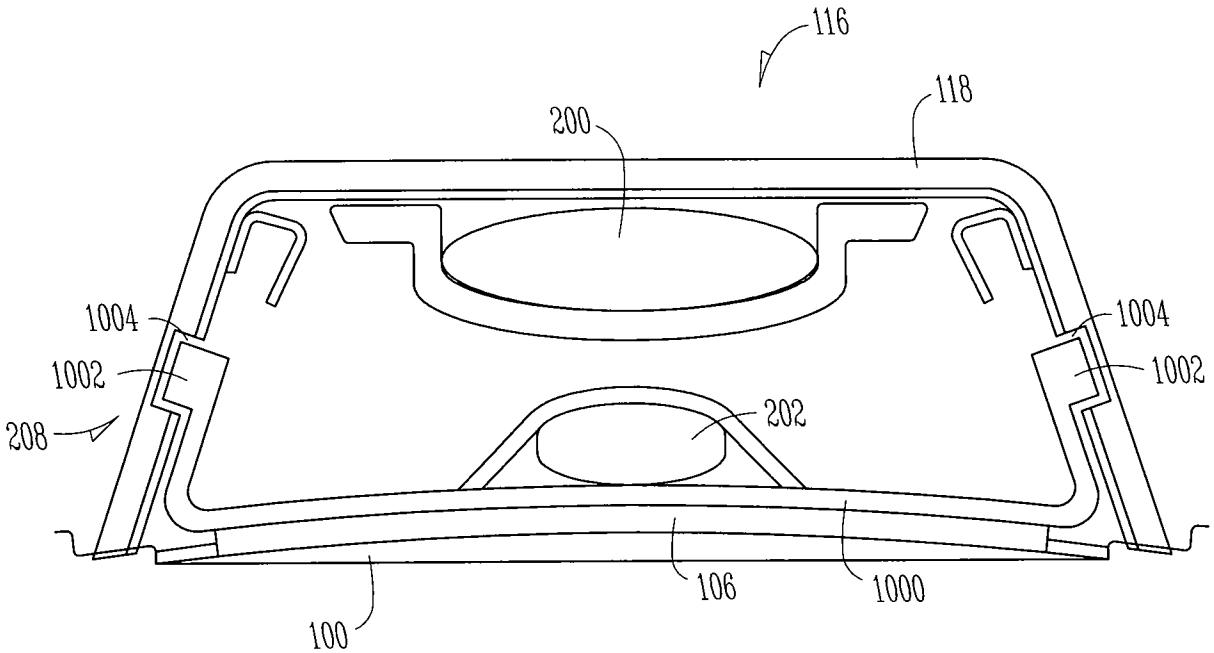
FIG. 10 is a sectional view of one example of a deployable raceway harness assembly including an in-flight deployment mechanism for sliding the assembly off of the multi-stage rocket body.

FIG. 10 shows another example of an in-flight deployment mechanism 208. As previously described, the deployable raceway harness assembly 116 includes a raceway cover 118 detachably coupled with the multi-stage rocket 100, for instance, the second stage 106 of the rocket. As shown in FIG. 10, the first cable bundle 200 is fastened to the raceway cover 118 while the second cable bundle 202 is fastened with the second stage 106 of the multi-stage rocket 100. The in-flight deployment mechanism 208 shown in FIG. 10 includes a rail bracket 1000 coupled with the multi-stage rocket 100. As shown, the rail bracket 1000 extends upwardly away from the second stage 106 and includes rails 1002 sized and shaped for reception within rail recesses 1004 formed within the raceway cover 118. When deploying the raceway cover 118 and the first cable bundle 200 the rails 1000 engage in sliding movement with the raceway cover 118 through the rail recesses 1004.

In operation, an explosive charge such as explosive charge 209 shown in FIG. 2 severs a feature such as the deployment restraint 800 shown in FIG. 8. Severing of is the deployment restraint allows the raceway cover 118 to slide along the rails 1002 and thereby separate from the multi-stage rocket 100. Stated another way, the deployment restraint 800 anchors the raceway cover 118 to the multi-stage rocket 100. After severing of the deployment restraint 800, for instance with the explosive charge 209, the raceway cover 118 with the rail recesses 1004 slides along the rails 1002 (e.g., through aerodynamic drag) and disengages from the multi-stage rocket 100 separating the raceway cover 118 and the first cable bundle 200 therefrom. One advantage of the in-flight deployment mechanism 208 shown in FIG. 10 is an explosive moment is not applied to the deployable raceway harness assembly 116 and a corresponding counter moment is not applied to the multi-stage rocket 100. In other words, the multi-stage rocket 100 does not experience a lateral force from the explosive charge and is thereby able to easily maintain its trajectory without needing adjustments through attitude control systems and the like for lateral movement otherwise caused by an explosive charge configured to cause rotation of the deployable raceway harness assembly.

Figure 11:
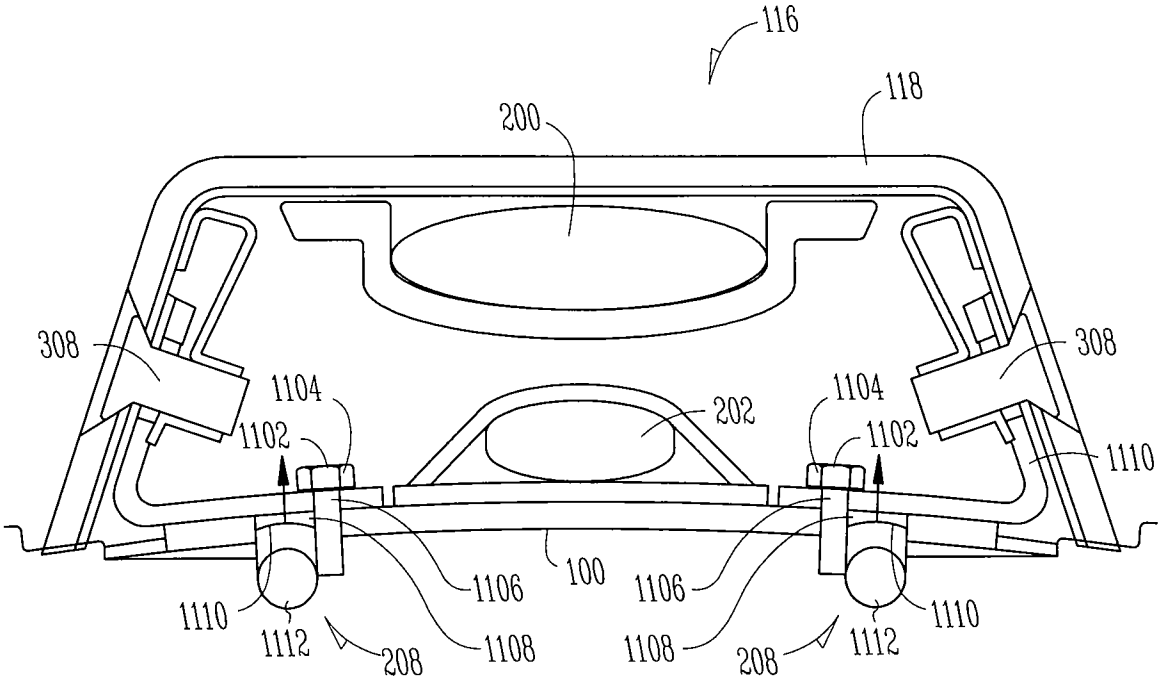
FIG. 11 is a sectional view of another example of a deployable raceway harness assembly including an in-flight deployment mechanism with expandable tubes configured to shear a coupling between the harness assembly and the multi-stage rocket.

FIG. 11 shows yet another example of an in-flight deployment mechanism 208 using a series of frangible bolts that are explosively sheared to separate the deployable raceway harness assembly 116 from the multi-stage rocket 100. As previously described, in one example, the raceway cover 118 is coupled with the multi-stage rocket 100 through raceway fasteners 308 coupled with a bracket. As shown in FIG. 11, the raceway fasteners 308 are coupled with a deployable raceway bracket 1100. The deployable raceway bracket 1100 is fastened to the multi-stage rocket 100 with frangible fasteners 1102 extending through the bracket and coupled with the multi-stage rocket. As shown in FIG. 11, the frangible fasteners 1102 include fastener heads 1104 coupled with fastener shafts 1106. In one example, the fastener shaft 1106 includes a weakened or scored portion configured to easily separate from the fastener head according to operation of the in-flight deployment mechanism 208. In one example, the frangible fasteners 1102 and the deployable raceway bracket 1100 extend over interfaces at each end of a rocket stage. In other words, at least the fasteners 1102 are not located or fixed to the first or second stages 104, 106. Instead the fasteners are located at airframe interfaces corresponding to the locations of the guidance unit 108 and the first rocket motor 107 in FIG. 1. For instance, the interfaces are solid structural rings extending around one or more of the guidance unit 108 and the first rocket motor 107. The remainder of the raceway cover 118 is coupled with the first or second stages 104, 106 through one or more raceway clips, such as clips 802 with release recesses 804 as shown in FIG. 8. Optionally, the raceway cover 118 is coupled to the first or second stage 104, 106 with other fasteners including, but not limited to, welds, adhesives, mechanical fittings and the like.

The in-flight deployment mechanism 208 further includes a tube recess 1108 positioned along the deployable raceway bracket 1100 as shown in FIG. 11. The tube recess 1108 is sized and shaped to receive an expandable tube 1110 therein. In one example, the expandable tube 1110 is constructed with materials, such as aluminum, configured to expand when subjected to a concussive load, for instance, from explosive charges within the expandable tube. The tube recess 1108 further includes a tube charge 1112 positioned within at least a portion of the expandable tube 1110. Optionally, the tube charge 1112 extends along the length of the expandable tube 1110. Where the frangible fasteners 1102 are provided at airframe interfaces (described above), the expandable tube 1110 and the tube charge 1112 are provided adjacent to the fasteners within the airframe interfaces. The tube charge 1112 is configured to detonate within the entirety of the expandable tube 1110 and thereby expand the expandable tube.

In operation, the tube charges 1112 within each of the tube recesses 1108 are initiated. Initiation of the charges 1112 creates an explosive pressure within the expandable tube 1110 that forces the expandable tube to enlarge outwardly in the direction shown in FIG. 11 (see the directional arrows). Violent engagement of the expandable tube 1110 with the deployable raceway bracket 1100 transmits a shearing force through the bracket 1100 to the fastener head 1104 of the frangible fastener 1102. The force transmitted by the expandable tube 1110 is sufficient to shear the frangible fastener 1102 and thereby frees the deployable raceway bracket 1100 from the multi-stage rocket 100. The deployable raceway harness assembly 116 is thereby jettisoned from the multi-stage rocket 100 with the raceway cover 118 and the first cable bundle 200 attached to the raceway cover.

FIGS. 12A-D show various examples of bundle fasteners, such as the bundle fastener 206 shown in FIG. 2. As previously described, the bundle fastener 206 fastens the first cable bundle 200 with the raceway cover 118 to form the deployable raceway harness assembly. Referring first to the FIG. 12A, the first cable bundle 200 is shown fastened to the raceway cover 118 through an adhesive 1200. In one example, the adhesive 1200 is configured to fasten the first cable bundle 200 to the raceway cover 118 in a robust manner to retain the first cable bundle 200 thereon through the acceleration of launch, operation of one or more staged rocket motors, rocket flight and separation of the deployable raceway harness assembly 116 from the multi-stage rocket 100.

Figure 12A:
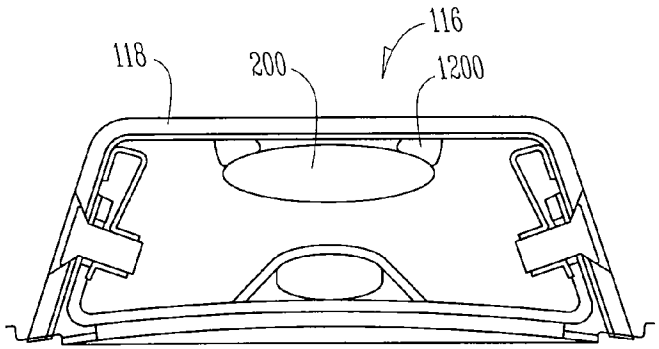
FIG. 12A is a sectional view of one example of an adhesive bundle fastener for coupling a first cable bundle with the raceway cover.
Figure 12B:
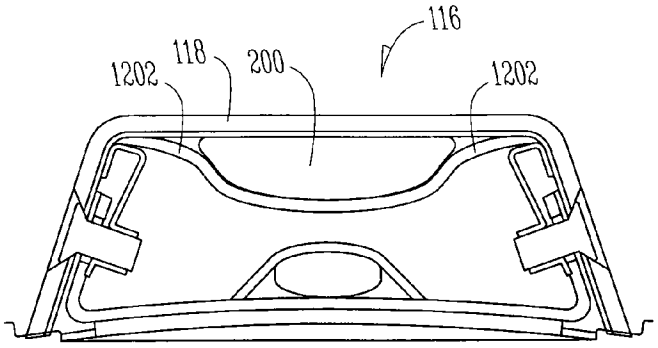
FIG. 12B is a sectional view of one example of a laminate bundle fastener for coupling the first cable bundle with the raceway cover.

FIG. 12B shows another example of a bundle fastener including a laminate 1202 extending over the first cable bundle 200. As shown, the laminate 1202 is laminated with the raceway cover 118 to form a continuous surface that fully covers at least a portion of the first cable bundle 200. By laminating the first cable bundle 200 to the raceway cover 118 additional features and structures such as straps, bolts and the like are eliminated. The first cable bundle 200 is effectively integrated with the raceway cover 118.

Figure 12C:
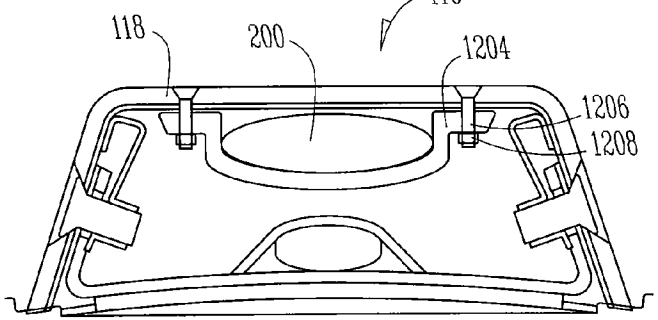
FIG. 12C is a sectional view of one example of a bundle fastener bracket for coupling the first cable bundle with the raceway cover.

FIG. 12C shows a bracket embodiment for the bundle fastener. The bracket couples the first cable bundle 200 with the raceway cover 118. As shown the cable bracket 1204 extends along at least a portion of the first cable bundle 200 and is coupled with the raceway cover 118 at two or more positions with bracket 1206 fasteners 1206. In one example, the bracket fasteners extend through the raceway cover 118 (e.g., are countersunk) and through the bundle bracket 1204 and are thereafter retained against the bundle bracket 1204 with nuts 1208. In use the first cable bundle 200 is positioned along the interior of the raceway cover. Once the first cable bundle 200 is positioned as desired the bundle bracket 1204 is fastened over top of the first cable bundle 200 to restrain the cable bundle and fix the bundle to the raceway cover 118 and form the deployable raceway harness assembly 116.

Figure 12D:
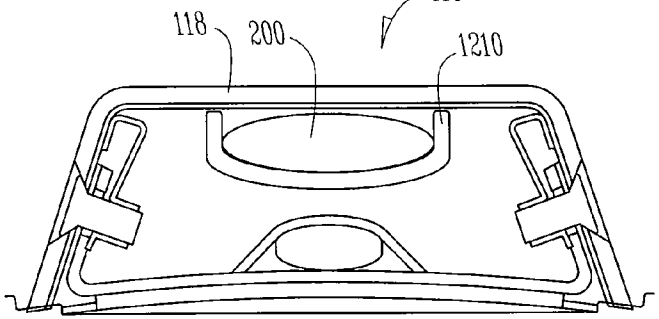
FIG. 12D is a sectional view of one example of a bundle fastener conduit for coupling the first cable bundle with the raceway cover.

FIG. 12D shows yet another example of a bundle fastener for coupling the first cable bundle 200 with the raceway cover 118. In the example shown in FIG. 12D, a bundle conduit 1210 extends along at least a portion of the raceway cover 118. For instance, the bundle conduit 1210 extends the length of the raceway cover 118 with openings for coupling the first cable bundle 200 with the second stage 106 (see FIG. 1) and the guidance unit 108. The bundle conduit 1210, in one example, is integrally formed with a raceway cover 118. In another example, the bundle conduit 1210 is welded or adhered to the interior surface of the raceway cover 118 to provide a passage for reception of the first cable bundle 200 therein.

Figure 13:
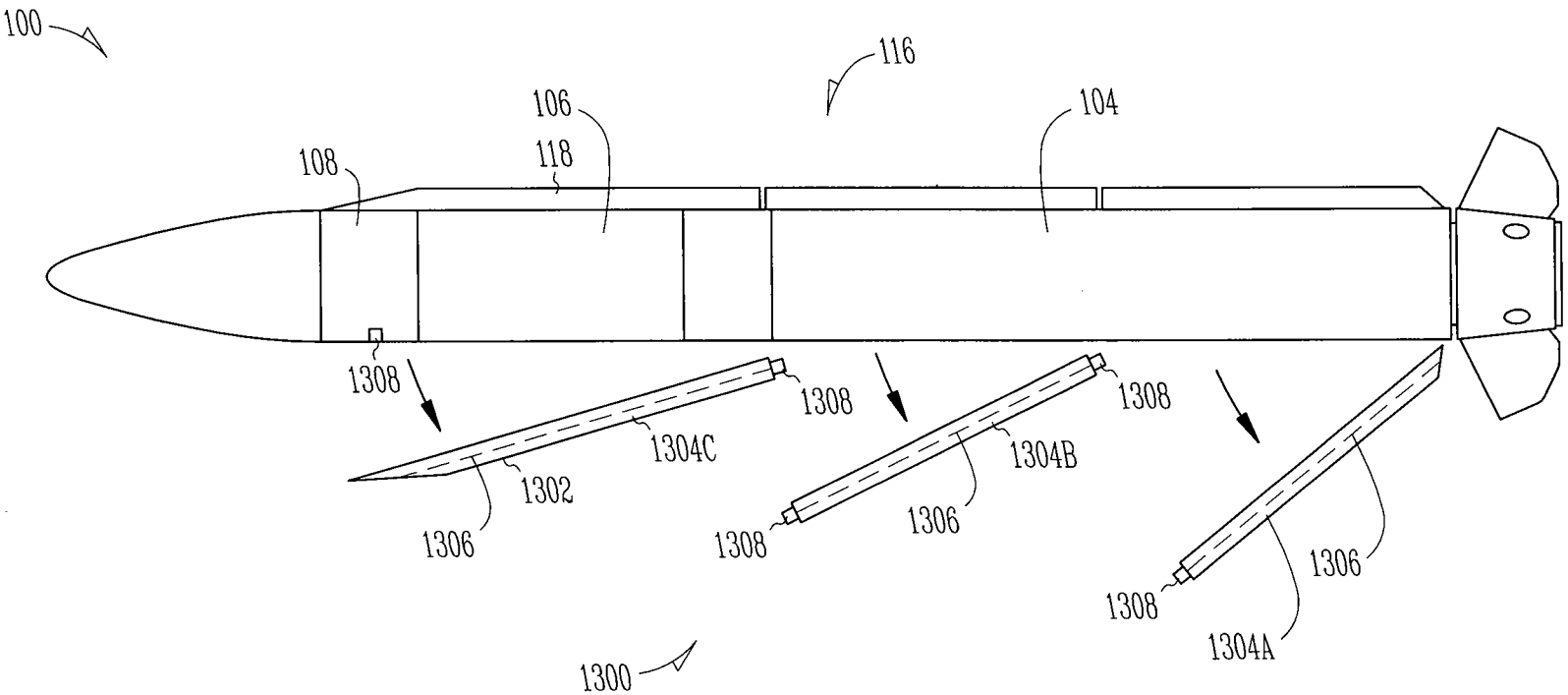
FIG. 13 is a side view of another example of a multi-stage rocket including a deployable launch raceway harness assembly.

FIG. 13 shows yet another example of a multi-stage rocket 100. As previously described, the multi-stage rocket 100 includes a deployable raceway harness assembly 116 including a raceway cover 118 covering a first cable bundle and a second cable bundle, such as bundles 200, 202 shown in FIG. 2. In the example shown in FIG. 13, a supplemental launch raceway harness assembly is provided. The deployable launch raceway harness assembly 1300 extends along the length of the multi-stage rocket 100. A launch cable bundle 1306 extends along the multi-stage rocket 100 from the guidance unit 108 to the first stage 104. The launch cable bundle 1306 is configured for coupling with the guidance unit 108 as well as a launch system such as a vertical launch system. In a similar manner to the deployable raceway harness assembly 116 the deployable launch raceway harness assembly 1300 is formed by a combination of the launch raceway cover 1302 and the launch cable bundle 1306. The launch cable bundle 1306 is coupled with the launch raceway cover 1302. When deployment of the deployable launch raceway harness assembly 1300 is required the launch raceway cover 1302 is jettisoned from the multi-stage rocket 100 and the launch cable bundle 1306 attached to the launch raceway cover 1302 is similarly separated from the multi-stage rocket 100 thereby eliminating ballast (the weight of the launch cabling and the cover) from the multi-stage rocket 100. For instance, after launch of the multi-stage rocket the launch cable bundle 1306 and the launch raceway cover 1302 are no longer needed.

Referring now to FIG. 13, in one example the launch raceway cover 1302 is formed by a plurality of segments such as raceway cover segments 1304A-C. The launch raceway cover segments 1304A-C are configured to deploy from the multi-stage rocket 100 at substantially the same time when separation of the deployable launch raceway harness assembly 1300 is desired. For example, each of the raceway cover segments 1304A-C includes a separate in-flight deployment mechanism configured to separately deploy the raceway cover segments 1304A-C and the associated launch cable bundles 1306 at substantially the same time. To facilitate the separation of each of the segments 1304A-C the launch cable bundle 1306 includes quick disconnect junctures 1308 between each of the segments 1304A-C. Further, a quick disconnect juncture 1308 is included at the guidance unit 108 to facilitate easy detachment of the launch cable bundle 1306 from the multi-stage rocket 100.

In other examples, the first and second cable bundles 200, 202 and the launch cable bundle 1306 are separately positioned around the multi-stage rocket 100 with corresponding separate raceway covers 118. In the case of at least the first cable bundle 200 and the launch cable bundle 1306 the corresponding deployable harness assemblies 116, 1300 are jettisoned from the multi-stage rocket 100 at the appropriate stages of launch and flight of the rocket to the target destination. Provision of separate launch raceway harness assemblies for each of the cable bundles provides a reliable method of deployment for each of the raceway covers and corresponding cable bundles without adding protective features for any underlying cable bundles that would otherwise be associated with the raceway cover. For instance, as shown in previous embodiments multiple cable bundles are enclosed by a single raceway cover such as raceway cover 118. By providing separate deployable raceway harness assemblies robust protection of underlying cable bundles that remain attached to the multi-stage rocket is avoided. \

In other examples, where selective deployment of the launch raceway harness assembly 1300 is conducted prior to deployment of the deployable raceway harness assembly 116 additional instructions are provided from the guidance unit 108 to the attitude control systems to compensate for any lateral motion caused by, for instance, an explosive charge within one or more of the raceway cover segments 1304A-C. In another example, where the deployable launch raceway harness assembly 1300 includes raceway covers 1302 configured to slide along the multi-stage rocket 100 instructions for the guidance unit 108 to compensate for lateral movement of the rocket due to deployment of the assembly are not needed. Instead the raceway cover segments 1304A-C slide off the multi-stage rocket 100 without otherwise providing any lateral force or moment to the multi-stage rocket 100.

CONCLUSION

The deployable raceway harness assembly and the multi-stage rockets using the same described herein minimize the weight of the multi-stage rockets and thereby enhance rocket performance. For instance, the burn out velocity of a multi-stage rocket is enhanced with attendant benefits to other characteristics including land area denied. The deployable raceway harness assembly enhances the rocket performance by forming a composite assembly of a raceway cover attached to a cable bundle. The cable bundle includes cabling used in one or more of a previously jettisoned stage, launch cabling and the like that serves only as ballast after separation of the stage. Stated another way, after separation of a stage the associated cabling serves no purpose and only provides added weight to the remaining portion of the multi-stage rocket. Separation of the deployable raceway harness assembly including the ballast cable bundle with the raceway cover significantly minimizes the weight of the remaining multi-stage rocket and correspondingly optimizes burnout velocity, land area denied and the like.

The deployable raceway harness assembly is able to minimize the weight of the multi-stage rocket by separating a first cable bundle from a second cable bundle. For instance, each of the first and second cable bundles is isolated according to the particular control functions provided (i.e., for the second stage and first stage, respectively). The first cable bundle is the longest and heaviest of the bundles and is associated with the first stage. The first cable bundle is attached to the raceway cover to form the deployable raceway harness assembly. As described above, jettisoning of the raceway cover thereby also separates the first cable bundle (the heaviest portion of the exterior rocket cabling) from the rocket to realize the weight savings described herein.

The weight saving benefit realized by jettisoning the deployable raceway harness assembly (including the raceway cover and the first cable bundle) is maximized when used in conjunction with the later stages of a multi-stage rocket. Because the weight of the deployable raceway harness assembly is much larger relative to the overall weight of the multi-stage rocket after separation of the first stage (or second stage in a three stage rocket) separation of the harness assembly for later stages provides a much larger percentage drop in weight. The rocket motor for the later stage of the multi-stage rocket thereby propels the minimized weight of the multi-stage rocket without the harness assembly to realize enhanced velocities and other desirable flight characteristics. Stated another way, once a first stage is jettisoned from a multi-stage rocket the remaining cables such as a first cable bundle and a raceway cover constitute a much larger percentage of the overall weight of the multi-stage rocket with a second stage (but not the now jettisoned first stage). Separation of the deployable raceway harness assembly thereby realizes a much greater percentage reduction of the remaining weight of the multi-stage rocket with corresponding enhanced benefit to rocket performance (e.g., burn out velocity, land area denied and the like).

Optionally, the deployable raceway harness assembly (including the raceway cover and the first cable bundle) is separated from the multi-stage rocket earlier in-flight, for instance, as the multi-stage rocket moves into the rarified atmosphere at relatively higher altitudes but prior to exiting the atmosphere. For instance, the first cable bundle and the raceway cover attached to the cable bundle are detached at lower altitudes (relative to space) to decrease the weight of the rocket earlier in the operation of one or more of the stages and thereby maximize the velocity attained. Deployment of the raceway harness assembly leaves the second cable bundle exposed. Since the second cable bundle is fastened to the multi-stage rocket and has a minimal profile relative to both the larger first cable bundle and the raceway cover atmospheric buffeting, heating and the like and damage to the second cable bundle are substantially minimized.

In the foregoing description, the subject matter has been described with reference to specific exemplary examples. However, it will be appreciated that various modifications and changes may be made without departing from the scope of the present subject matter as set forth herein. The description and figures are to be regarded in an illustrative manner, rather than a restrictive one and all such modifications are intended to be included within the scope of the present subject matter. Accordingly, the scope of the subject matter should be determined by the generic examples described herein and their legal equivalents rather than by merely the specific examples described above. For example, the steps recited in any method or process example may be executed in any order and are not limited to the explicit order presented in the specific examples. Additionally, the components and/or elements recited in any apparatus example may be assembled or otherwise operationally configured in a variety of permutations to produce substantially the same result as the present subject matter and are accordingly not limited to the specific configuration recited in the specific examples.

Benefits, other advantages and solutions to problems have been described above with regard to particular examples; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present subject matter, in addition to those not specifically recited, may be varied or otherwise particularly adapted to specific environments, manufacturing specifications, design parameters or other operating requirements without departing from the general principles of the same.

The present subject matter has been described above with reference to examples. However, changes and modifications may be made to the examples without departing from the scope of the present subject matter. These and other changes or modifications are intended to be included within the scope of the present subject matter, as expressed in the following claims.

It is to be understood that the above description is intended to be illustrative, and not restrictive. Many other examples will be apparent to those of skill in the art upon reading and understanding the above description. It should be noted that examples discussed in different portions of the description or referred to in different drawings can be combined to form additional examples of the present application. The scope of the subject matter should, therefore, be determined with reference to the appended claims, along with the full scope of equivalents to which such claims are entitled.

What is claimed is:

1. A deployable raceway harness assembly for use with a multi-stage rocket, the deployable raceway harness assembly comprising:

a first cable bundle configured to extend across a second stage of a multi-stage rocket from a guidance unit to a first stage of the rocket, a deployable raceway cover configured for detachable coupling with the multi-stage rocket, the deployable raceway cover to extend over at least the first cable bundle and a second cable bundle, and the first cable bundle is fastened to the deployable raceway cover, the second cable bundle is configured to extend from the guidance unit to the second stage, the second cable bundle is shorter than the first cable bundle, and an in-flight deployment mechanism to detach both the deployable raceway cover and the first cable bundle extending across the second stage from the multi-stage rocket in-flight leaving the second cable bundle extending to the second stage in place, the in-flight deployment mechanism including:

a restraint that retains the deployable raceway cover along the multi-stage rocket when the deployable race cover is detachably coupled with the multi-stage rocket, and an explosive charge, initiation of the explosive charge severs the restraint and detaches the deployable raceway cover and the first cable bundle.

2. The deployable raceway harness assembly of claim 1 comprising:

a second deployable raceway harness assembly including:

a third cable bundle configured to extend across the second stage from the guidance unit to the first stage, a second deployable raceway cover configured for detachable coupling with the multi-stage rocket and positioning on an opposed surface of the multi-stage rocket relative to the deployable raceway harness assembly, the second deployable raceway cover extends over at least the third cable bundle and a fourth cable bundle configured to extend from the guidance unit to the second stage, the fourth cable bundle is shorter than the third cable bundle, and the second deployable raceway cover is fastened to the third cable bundle, and a second in-flight deployment mechanism configured to detach both the second deployable raceway cover and the third cable bundle.

3. The deployable raceway harness assembly of claim 1, wherein the deployable raceway cover includes a plurality of segments covering portions of the first and second cable bundles, and the in-flight deployment mechanism is configured to detach at least one of the plurality of segments from the multi-stage rocket.

4. The deployable raceway harness assembly of claim 1, wherein the deployable raceway cover includes a raceway channel configured to receive the first cable bundle and the second cable bundle.

5. The deployable raceway harness assembly of claim 1, wherein the second cable bundle is configured for fastening along the guidance unit and the second stage.

6. The deployable raceway harness assembly of claim 5, wherein a cable covering is interposed between the first and second cable bundles, and the cable covering extends over the second cable bundle cable covering, and the cable covering is configured to fasten the second cable bundle to the multi-stage rocket.

7. The deployable raceway harness assembly of claim 1, wherein the detachment mechanism consists of essentially one of:

an expandable tube extending along the second stage between the multi-stage body and the deployable raceway cover, the expandable tube is filled with an explosive, and detonation of the explosive expands the tube and shears one or more fasteners coupled between the deployable raceway cover and the second stage; and a rail extending along at least the second stage, and a rail slide on the deployable raceway cover.

8. The deployable raceway harness assembly of claim 1, wherein the detachment mechanism includes:

an explosive charge near a leading edge of the deployable raceway cover, and a detachable hinge configured for coupling near a trailing edge of the deployable raceway cover and the multi-stage rocket.

9. The deployable raceway harness assembly of claim 1, wherein the deployable raceway cover is configured for coupling with the multi-stage body with one or more raceway clips, each raceway clip includes a release recess extending along the multi-stage rocket, and each of the release recesses opens away from the guidance unit toward an aft portion of the second stage.

10. The deployable raceway harness assembly of claim 1, wherein the first cable bundle is fastened to the deployable raceway cover with straps.

11. A multi-stage rocket comprising:

a guidance unit coupled with a second rocket stage, the second stage is interposed between a first rocket stage and the guidance unit, the guidance unit is configured to control operation of first and second rocket motors associated with the respective first and second rocket stages; and wherein in a first stage configuration a first cable bundle extends from the guidance unit to the first stage, a second cable bundle extends from the guidance unit to the second stage, a deployable raceway cover extends over the first and second cable bundles, and the first cable bundle is fastened to the deployable raceway cover;

wherein in a second stage configuration the deployable raceway cover and the fastened first cable bundle are detached from the guidance unit and the second stage, and the first stage is detached from the second stage; and an in-flight deployment mechanism adjacent to the deployable raceway cover, the in-flight deployment mechanism is configured to detach both the deployable raceway cover and the first cable bundle from the multi-stage body in-flight leaving the second cable bundle extending to the second stage in place in the second stage configuration.

12. The multi-stage rocket of claim 11 comprising a multi-stage body including the first and the second stages, wherein the multi-stage body is configured to transition between the first stage configuration and the second stage configuration.

13. The multi-stage rocket of claim 11 comprising a launch configuration, and in the launch configuration the first cable bundle extends from the guidance unit to the first stage, the second cable bundle extends from the guidance unit to the second stage, the deployable raceway cover extends over the first and second cable bundles, a launch cable bundle extends from the guidance unit and is configured for coupling with a launch system, and a launch raceway cover extends over the launch cable bundle.

14. The multi-stage rocket of claim 13, wherein in the first stage configuration the launch cable bundle is fastened to the launch raceway cover and both the launch cable bundle and the launch raceway cover are detached from the guidance unit and the first and second stages.

15. The multi-stage rocket of claim 11, wherein the first cable bundle includes a quick disconnect juncture at the guidance unit, and the second cable bundle includes junctures at the guidance unit and the second stage.

16. The multi-stage rocket of claim 11, wherein the first cable bundle includes:

first stage booster control cabling, first stage attitude control cabling, and launch system cabling.

17. The multi-stage rocket of claim 11, wherein one or more of the first cable bundle or the second cable bundle consists of essentially one or more of: RF waveguides, mechanical linkages, pyrotechnic cabling, control cabling, electronics and pressurized gas lines.

18. The multi-stage rocket of claim 11 comprising a payload coupled with one or more of the guidance unit and the second stage.

19. A method of controlling stages of a multi-stage rocket comprising:

controlling a first stage with a guidance unit by a first cable bundle, the first cable bundle extending across a second stage from the guidance unit to the first stage, the second stage is interposed between the first stage and the guidance unit;

separating a deployable raceway harness assembly extending across the second stage from the second stage, the deployable raceway harness assembly includes the first cable bundle extending across the second stage and a raceway cover fastened with the first cable bundle cover, and separating includes:

initiating an explosive charge, and severing a restraint retaining the deployable raceway harness assembly along the second stage according to the initiation; and controlling, after separation of the first and second stages, the second stage with the guidance unit coupled with the second stage by a second cable bundle.

20. The method of claim 19, wherein controlling the second stage of the multi-stage rocket includes operating a second rocket motor in the second stage after separating of the deployable raceway cover and the first cable bundle.

21. The method of claim 19, wherein separating the deployable raceway harness assembly includes pulling the first cable bundle away from the multi-stage rocket with the deployable raceway cover.

22. The method of claim 21, wherein separating the deployable raceway harness assembly detaches the first cable bundle from the guidance unit at one or more quick disconnect junctures.

23. The method of claim 19, wherein separating the deployable raceway harness assembly includes rotating the deployable raceway cover away from the multi-stage body.

24. The method of claim 19, wherein separating the first stage and the deployable raceway harness assembly occurs immediately prior to exiting atmosphere.

25. The method of claim 19, wherein the deployable raceway harness assembly is separated at substantially the same time a nose cone covering a payload is jettisoned.

26. The method of claim 19 comprising covering the first and second cable bundles with the deployable raceway cover during atmospheric flight.

27. The method of claim 19, wherein controlling the first stage includes:

controlling first stage ignition and burning of a first rocket motor with first stage booster control cabling, controlling the attitude of the multi-stage rocket with first stage attitude control cabling, and the first stage control cabling and the first stage attitude control cabling are included in the first stage cable bundle.

28. The method of claim 19 comprising separating a launch raceway cover fastened to a launch cable bundle extending from the guidance unit, the launch cable bundle is configured for coupling with a launch system.

29. The method of claim 28 comprising:

launching the multi-stage rocket; and separating the launch raceway cover and the launch cable bundle immediately after launch.

30. The method of claim 19, wherein separating the deployable raceway harness assembly includes minimizing the aerodynamic profile of the multi-stage rocket.

* * * * *